US005327802A

United States Patent [19]

Yu

[11] Patent Number: 5,327,802

[45] Date of Patent: Jul. 12, 1994

[54] COMBINATION PLIERS

[76] Inventor: Chin-Yung Yu, No. 5, Chent Te Lane 3, Shu Te Li, South Area, Taichung, Taiwan

[21] Appl. No.: 65,252

[22] Filed: May 21, 1993

[51] Int. Cl.[5] ..... B25B 7/02

[52] U.S. Cl. ..... 81/312; 81/302; 81/303; 81/485; 29/229

[58] Field of Search ..... 81/300, 302-307, 81/311-312, 385, 381, 485-486; 29/225, 229

[56] References Cited

U.S. PATENT DOCUMENTS 1,539,526 5/1925 Swickard ..... 81/303

4,793,224 12/1988 Huang ..... 81/302

*Primary Examiner*—D. S. Meislin

*Attorney, Agent, or Firm*—Bacon & Thomas

[57] ABSTRACT

A combination pliers including a first pliers body consisted of two pivoted blades with insulated grips, a second pliers body consisted of two pivoted blades attached to the pivot joint of the first pliers body, wherein the jaws of the first pliers body move apart from each other and the jaws of the second pliers body come together as the two insulated grips of the first pliers body are squeezed toward each other; the insulated grips of the first pliers body are returned to their former positions by a torsional spring as the inward pressure is released, causing the jaws of the first pliers body to come together and the jaws of the second pliers body to move apart from each other.

2 Claims, 5 Drawing Sheets

COMBINATION PLIERS

BACKGROUND OF THE INVENTION

The present invention relates to a combination pliers which includes two linked pliers bodies controlled through the same pair of grips for clamping the outer diameter or expanding the inner diameter of a C-shaped retainer, etc. respectively.

A variety of pliers are manufactured and widely used for different purposes. FIG. 1A illustrates a structure of pliers for clamping accessories, comprising two pivoted blades, each having one end terminated to a jaw fastened with a respective clamping plate to hold a respective jaw tip and an opposite end terminated to an insulated grip, and a torsional spring retained between the blades. The jaws are normally opened, and they come together to squeeze the accessory placed therebetween as the grips are squeezed inwards toward each other. FIG. 1B illustrates another structure of pliers used for doing an expanding work. Similar to the pliers shown in FIG. 1A, the pliers also comprises two pivoted blades and a torsional spring retained between the blades and spaced from the pivot joint. The jaws are normally closed, and they move apart to expand a clamp, C-shaped retainer, etc. as the grips of the blades are squeezed inwards toward each other. Because the aforesaid two different types of pliers are designed for different purposes, they are not interchangeable.

FIGS. 2A and 2B illustrate another two different types of pliers, one having a curved needle nose designed to reach around obstructions, the other having a crescent long nose. The nose, namely the jaw tips of the jaws of the pliers are not changeable once the pliers are made. These two different types of pliers are still not interchangeable. For a different operation, a different type of pliers should be separately used. Therefore, both types of pliers are needed when clamping and expanding operations are to be done. The tool cost is greatly increased when different types of pliers are prepared. When different pliers are prepared, much storage space is needed. Further, it is inconvenient to carry various tools with oneself.

FIGS. 3A and 3B illustrate an adjustable pliers which can be adjusted for different purposes. The adjustable pliers comprises two pivoted handles pivotably connected by a pivot, each handle having two pins disposed on two opposite sides at different elevations, a spring supported between the handles below the pivot, and two Jaw plates pivotably mounted on the pivot, each jaw plate having two spaced pin holes. By attaching the Jaw plates to the handles at either side with either pin hole of each jaw plate mounted on the pin on either handle on the corresponding side, the pliers is alternatively arranged into either form as shown in FIG. 3A or 3B. As the pliers is arranged into the form shown in FIG. 3A, the Jaw plates are normally opened and used for a clamping operation by squeezing the handles inwards toward each other. As the pliers is arranged into the form shown in FIG. 3B, the jaw plates are normally closed and used for an expanding operation by squeezing the handles inwards toward each other. This structure of pliers is practical for both clamping and expanding operations. However, it is expensive to manufacture, and needs much storage space. Furthermore, changing the positions of the jaw plates is not easy.

SUMMARY OF THE INVENTION

The present invention has been accomplished under the aforesaid circumstances. It is the principal object of the present invention to provide a combination pliers which can be used for clamping or expanding C-shaped retainers, etc. It is another object of the present invention to provide a combination pliers which can be replaceably attached with different jaw tips according to different working purposes. According to the preferred embodiment of the present invention, two reversed pliers bodies are attached together by the common pivot so that the jaw plates of the two pliers bodies work in different directions as the grips on one pliers body are squeezed inwards toward each other. Respective clamping plates are detachably fastened to the jaws of the pliers bodies for holding different jaw tips according to different working requirements.

DESCRIPTION OF THE PREFERRED EMBODIMENT

Figure 1B:
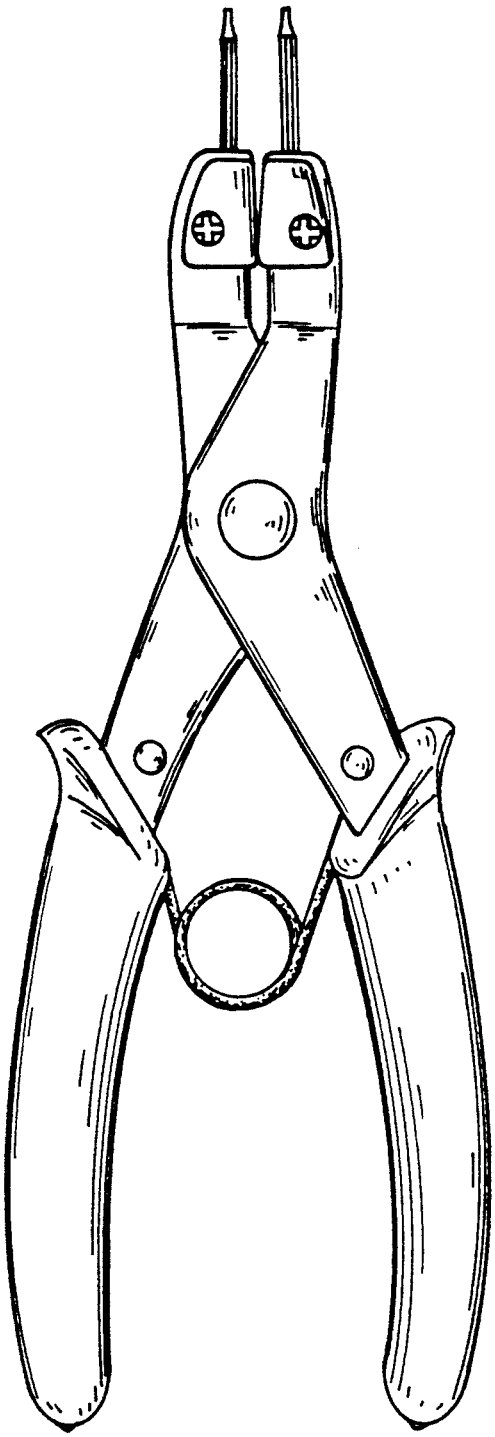
Fig. 1B. PRIOR ART
FIG. 1B shows a prior at pliers designed for expanding the inner diameter of C-shaped retainers
Figure 1A:
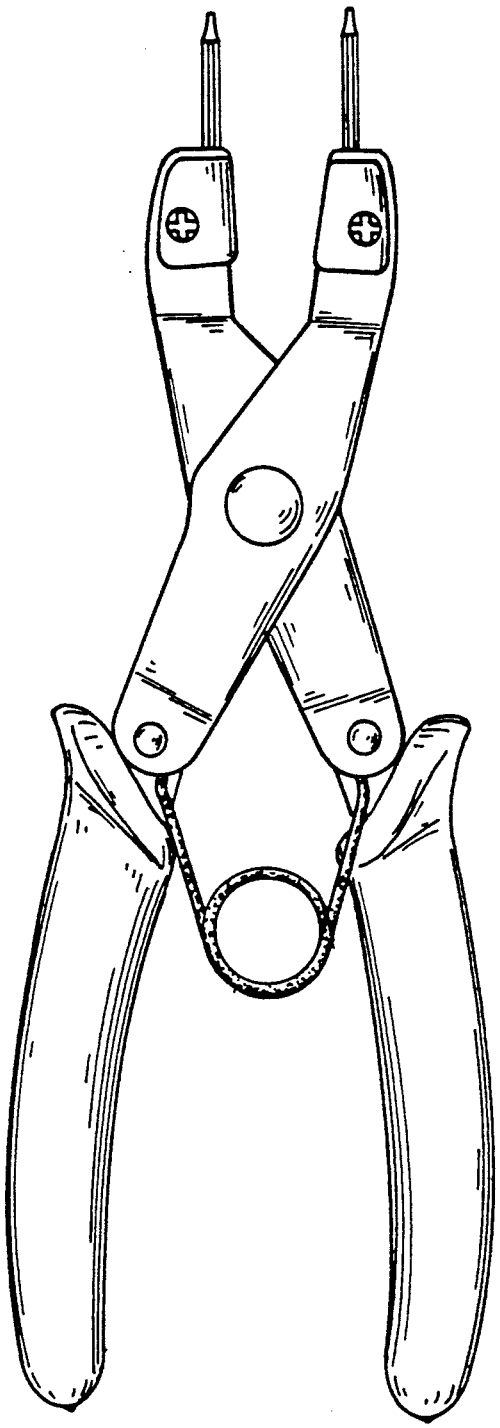
Fig. 1A. PRIOR ART
FIG. 1A shows a prior art pliers designed for clamping the outer diameter of C-shaped retainers.
Figure 2A:
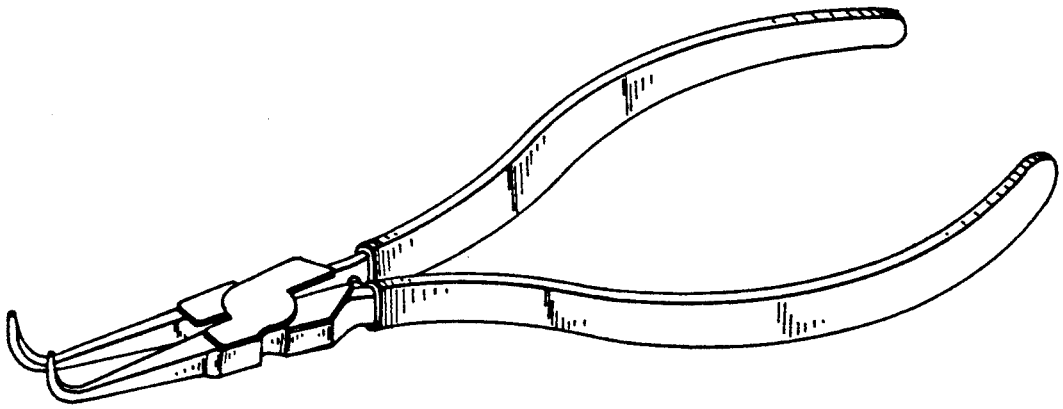
Fig. 2A. PRIOR ART
FIG. 2A shows a prior art pliers having a curved needle nose designed to reach around obstructions.
Figure 2B:
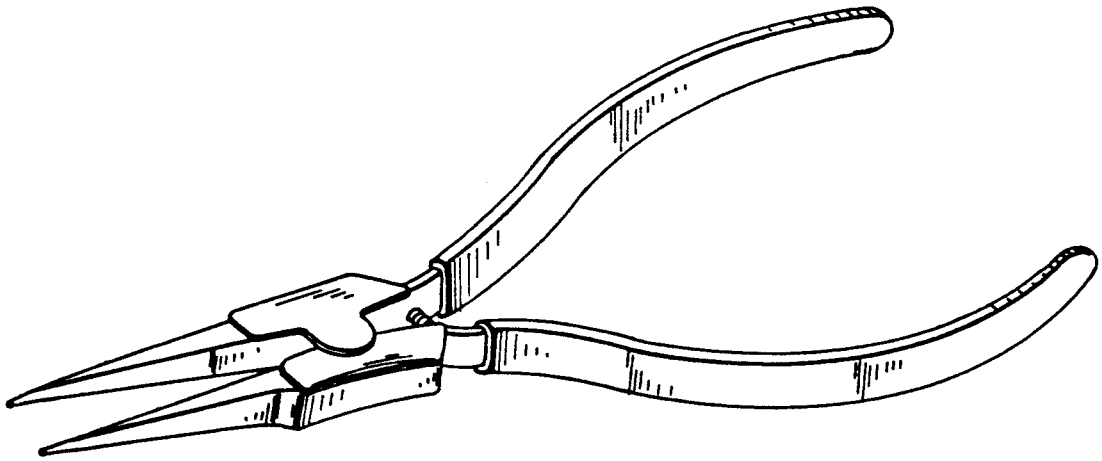
Fig. 2B. PRIOR ART
FIG. 2B shows a prior art pliers having a crescent long nose.
Figure 3A:
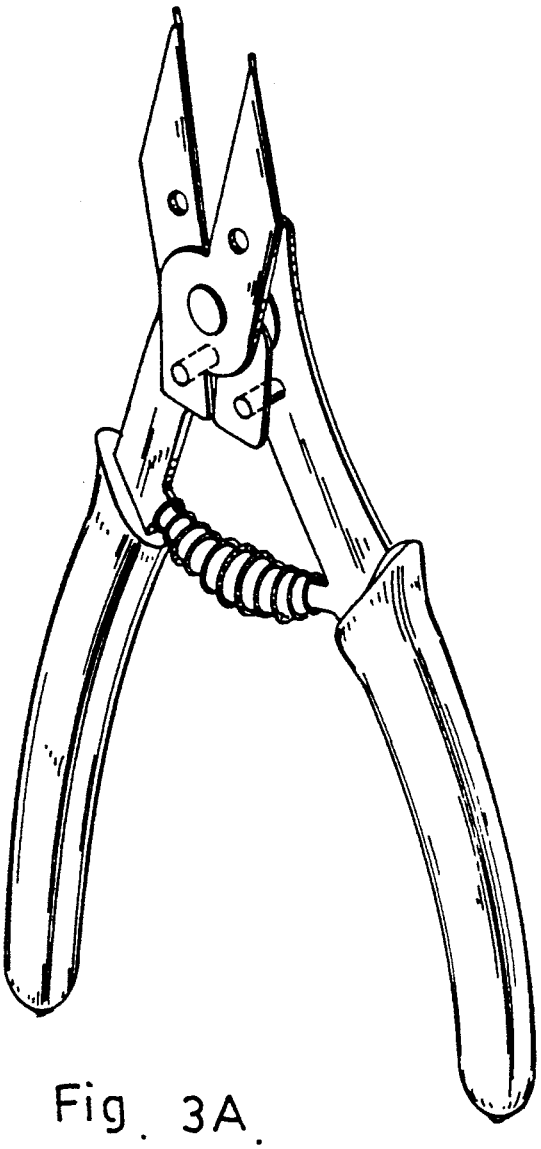
Fig. 3A. PRIOR ART
FIG. 3A shows a prior art combination pliers when arranged for clamping the outer diameter of C-shaped retainers.
Figure 3B:
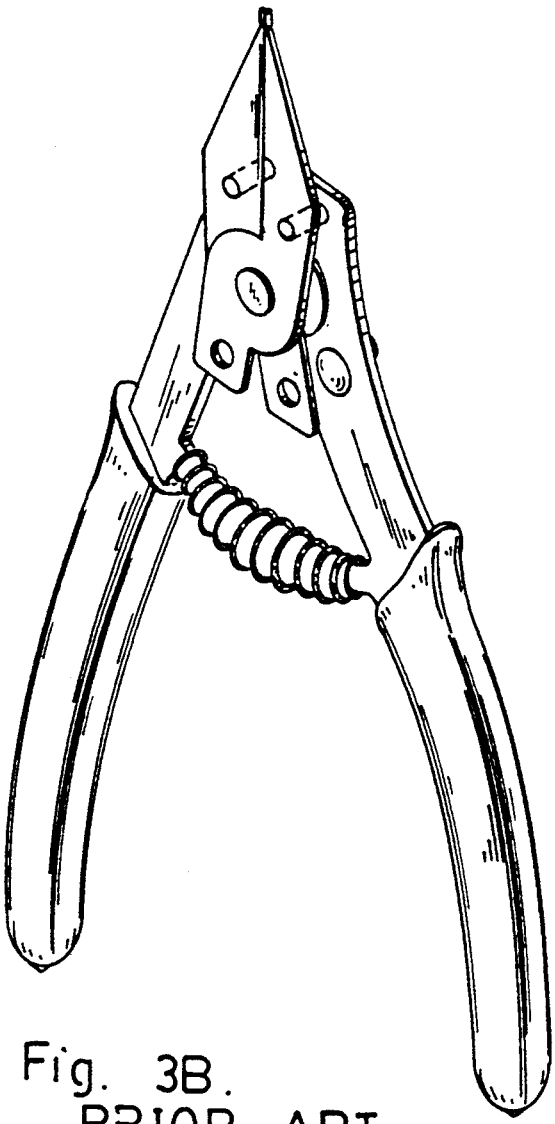
Fig. 3B. PRIOR ART
FIG. 3B shows the combination pliers of FIG. 3A arranged into an alternate form for expanding the inner diameter of C-shaped retainers.
Figure 4:
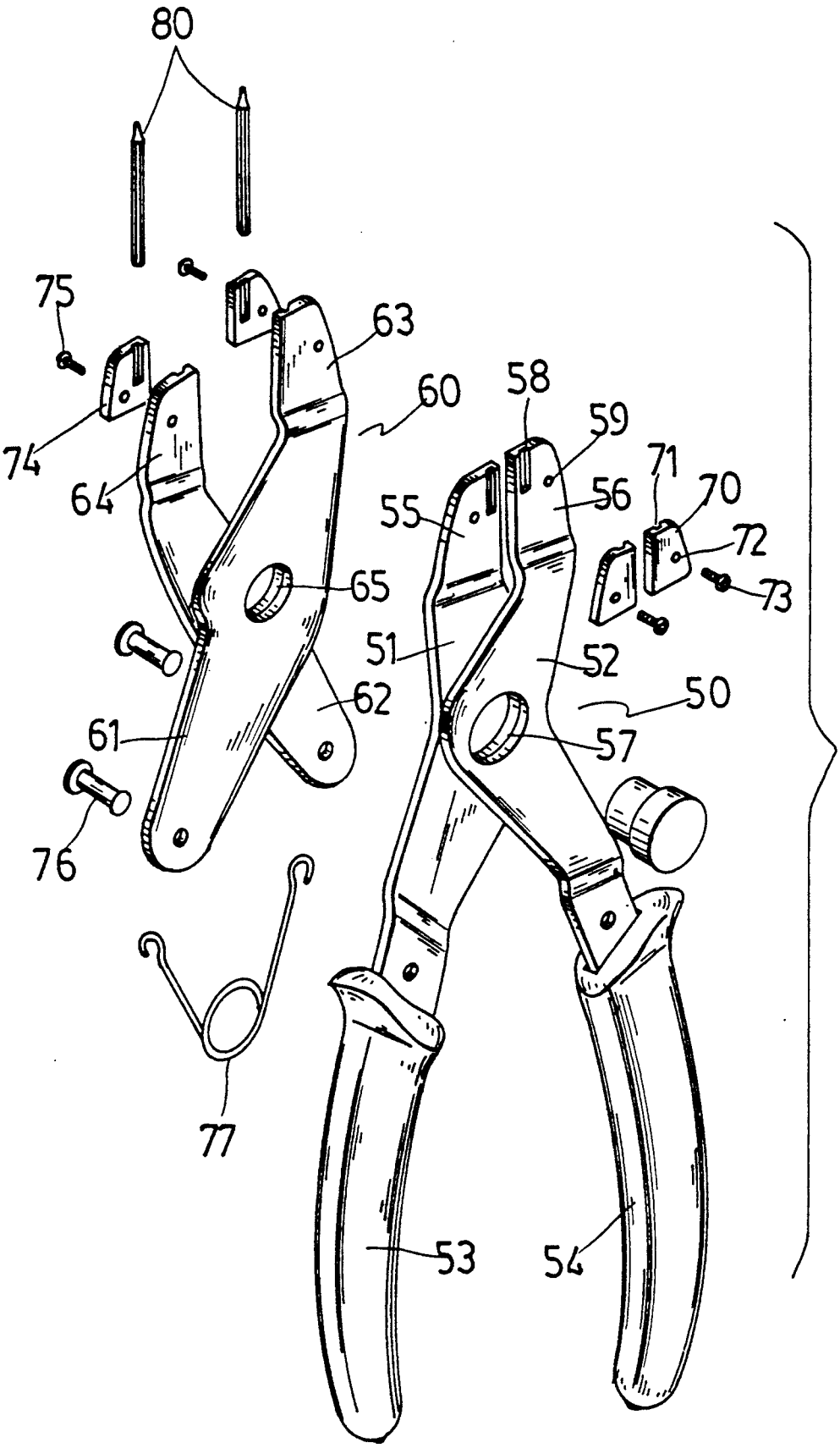
FIG. 4 is a perspective exploded view of a combination pliers according to the preferred embodiment of the present invention.

Referring to FIG. 4, a combination pliers in accordance with the present invention is generally comprised of a first pliers body 50 and a second pliers body 60 connected together by a pivot.

The first pliers body 50 comprises two blades 51;52 pivoted at a pivot point 57, each having one end terminated to a respective insulated grip 53 or 54 and an opposite end terminated to a respective jaw 55 or 56. The jaw 55 or 56 of each blade 51 or 52 has an elongated groove 58 in the longitudinal direction and a screw hole 59 spaced from the elongated groove 58. A respective clamping plate 70 is fastened to the jaw 55 or 56 of each blade 51 or 52. The clamping plate 70 has an elongated groove 71 and a screw hole 72 corresponding to the groove 58 and screw hole 59 on the jaw 55 or 56. A respective clamping plate 70 is fastened to the jaw 55 or 56 of either blade 51 or 52 by threading a respective screw 73 into the screw hole 72 on the respective clamping plate 70 and the screw hole 59 on the respective Jaw 55 or 56. As a respective clamping plate 70 is fastened to the respective jaw 55 or 56, any of a variety of jaw tips 80 may be retained in the elongated grooves 58;71 between the clamping plate 70 and the jaw 55 or 56.

The second pliers body 60 is relative shorter than the first pliers body 50, comprised of two blades 61;62 pivoted at a pivot point 65. The pivot point 65 of the second pliers body 60 is connected to the pivot point 57 of the first pliers body 50 by the same pivot. Each blade 61 or 62 of the second pliers body 60 has one end respectively connected to either blade 51 or 52 of the first pliers body 50 by a respective pin 76, and an opposite end terminated to a respective jaw 63 or 64. A respective clamping plate 74 is respectively fastened to the Jaw 63 or 64 of either blade 61 or 62 of the second pliers body 60 by a respective screw 75 for holding any of a variety of jaw tips 80. A torsional spring 77 is retained between the two blades 51;52 of the first pliers body 50 near the insulated grips 53;54. The torsional spring 77 stretches the insulated grips bilaterally outwards, causing the two jaws 55;56 of the first pliers body 50 to close together and the two jaws 63;64 of the second pliers body 60 to separate from each other.

Figure 5:
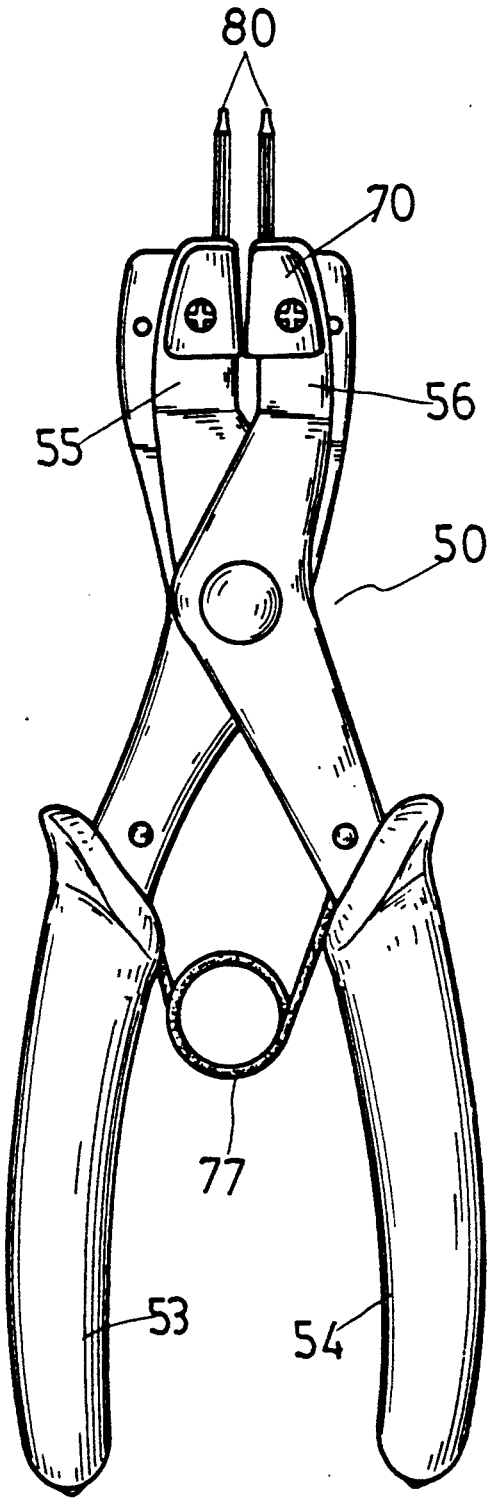
FIG. 5 shows two jaw tips respectively fastened to the jaws of the first pliers body of the combination pliers of the present invention for clamping the outer diameter of C-shaped retainers.

Referring to FIG. 5, two jaw tips 80 are respectively fastened to the two jaws 55;56 of the first pliers body 50. As the insulated grips 53;54 are squeezed toward each other, the jaws 55;56 carry the jaw tips 80 apart to expand a C-shaped retainer or the like.

Figure 6:
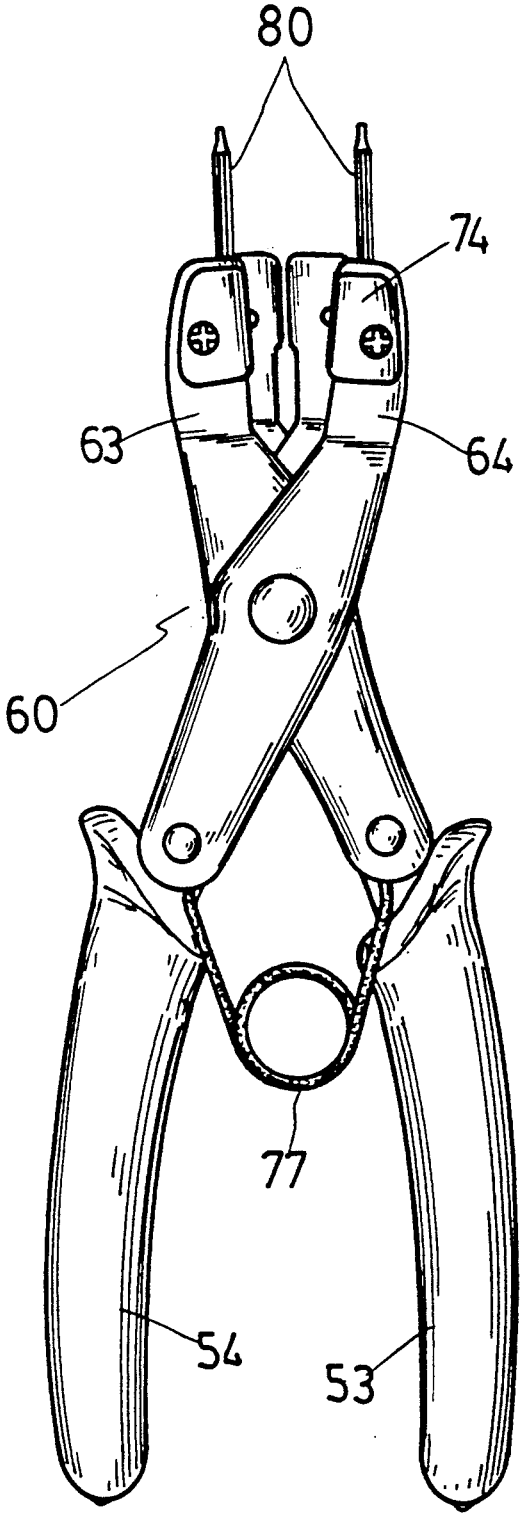
FIG. 6 shows two jaw tips respectively fastened to the Jaws of the second pliers body of the combination pliers of the present invention for expanding the inner diameter of C-shaped retainers.

Referring to FIG. 6, two jaw tips 80 may be respectively fastened to the two jaws 63;64 of the second pliers body 50. As the insulated grips 53;54 are squeezed toward each other, the jaw tips 80 on the jaws 63;64 come together to compress a C-shaped retainer or the like.

As indicated, the combination pliers of the present invention can be used for expanding a C-shaped retainer or compressing it simply by fastening jaw tips to the first pliers body 50 or the second pliers body 60.

I claim:

1. A combination pliers comprising a first pliers body having two blades pivotally connected by a pivot, each blade of said first pliers body having one longer end terminated to a respective insulated grip and an opposite end terminated to a respective jaw, a torsional spring supported between the two blades of said first pliers body near each insulated grip, and a second pliers body having two blades pivotally connected together by said pivot, each blade of said second pliers body having one end terminated to a respective Jaw disposed near the jaws of the blades of said first pliers body and an opposite end respectively connected to either blade of said first pliers body, wherein the jaws of said first pliers body move apart from each other and the jaws of said second pliers body come together as the two insulated grips of said first pliers body are squeezed toward each other; the insulated grips of said first pliers body are returned to their former positions by said torsional spring as the inward pressure is released, causing the jaws of said first pliers body to come together and the jaws of said second pliers body to move apart from each other.

2. A combination pliers comprising a first pliers body having two blades pivotally connected by a pivot, each blade of said first pliers body having one longer end terminated to a respective insulated grip and an opposite end terminated to a respective jaw, a torsional spring supported between the two blades of said first pliers body near each insulated grip, and a second pliers body having two blades pivotally connected together by said pivot, each blade of said second pliers body having one end terminated to a respective jaw disposed near the jaws of the blades of said first pliers body and an opposite end respectively connected to either blade of said first pliers body, wherein the jaws of said second pliers body move apart from each other and the jaws of said first pliers body come together as the two insulated grips of said first pliers body are squeezed toward each other; the insulated grips of said first pliers body are returned to their former positions by said torsional spring as the inward pressure is released, causing the jaws of said second pliers body to come together and the jaws of said first pliers body to move apart from each other.

* * * * *